United States Patent [19]

Mills

[11] Patent Number: 5,044,139

[45] Date of Patent: Sep. 3, 1991

[54] METHOD OF REPLACING POST TENSIONED BEAMS

[75] Inventor: Tyrone T. Mills, Ramsey, Minn.

[73] Assignee: D. H. Blattner & Sons, Inc., Avon, Minn.

[21] Appl. No.: 554,966

[22] Filed: Jul. 20, 1990

Related U.S. Application Data

[63] Continuation of Ser. No. 355,923, May 23, 1989, abandoned.

[51] Int. Cl.[5] ..... E04C 5/08

[52] U.S. Cl. ..... 52/741; 52/223 R

[58] Field of Search ..... 52/744, 743, 741, 230, 52/226, 223 R

[56] References Cited

U.S. PATENT DOCUMENTS

| | | | |
|---|---|---|---|
| 3,785,617 | 1/1974 | Friedrich . | |
| 4,574,545 | 3/1986 | Reigstad | 52/223 |
| 4,616,458 | 10/1986 | Davis et al. . | |
| 4,621,943 | 11/1986 | Swanson . | |

OTHER PUBLICATIONS

Progressive Architecture, Aug. 1959, pp. 139–140.

"A Stable Post Pensioning"; Building Design & Construction, Jun. 1974, pp. 64–65.

G. M. Roberts, "Report on I-59 St. Clair/Etowah County Bridge Deck Deterioration", Jul. 16, 1982.

Interoffice Memorandum of Stresssteel Corporation from E. Schechter, "Strand Failures at Watergate Apartment Complex", 12/1/71.

Daily Log Books of "Chuck" of VSL Corp. of Springfield, VA dated, Jul. 1970.

"Interim Report of Tendon Distress of the Roof Level at the East Medical Campus Parking Structure", University of Michigan, Sep. 17, 1979, by Wiss, Janney, Elstner & Associates, Inc.

"Post Tensioned Less Expensive, Faster than Renovating by Shoring" article in Journal of American Concrete (Proceedings vol. 72.

PCI Design Handbook (1971 Edition).

"Preliminary Investigation of Deterioration of East Medical" by Carl Peterson and Joan Riordan, Aug. 22, 1979.

"Correction of Mislocated Tendons in Denver Parking Structure" from Post Tensioning Institute Journal, Nov. 1981, by Ib Falk Jorgensen.

"Specification for the Repair and Restoration of Columbia Mall Parking Garage", Sep. 17, 1982 prepared by Wiss, Janney, Elstner and Assoc.

Blueprint of 6/27/83 by Raths, Raths, and Johnson, Inc.

"Combating Ravages of Climate on Parking Ramps Requires Remedies Involving Design, Construction and Operation" by Edward Wicklund, 9/7/84.

"Problems Encountered with Post-Tensioned Unbonded Tendons" By Donald A. Erickson, from Building Official and Code Admin., pp. 12–15.

"Repair of Prestressed Concrete-Restressing of Replaced Prestressed Concrete," by Philip Mohr, FIP Notes, (Jan. 1984).

Pp. 355–356 of Post Tensioning Manual, published 1985.

"Corrosion Resistance of Unbonded Post-Tensioned Slabs" by Carl Peterson, from U of M, Extension Center, Mar. 11, 1987.

"Epoxy Plastics in Architecture" by Guy G. Rothenstein. Aug., 1959 issue.

*Primary Examiner*—John E. Murtagh

*Attorney, Agent, or Firm*—Vidas & Arrett

[57] ABSTRACT

A method for repairing damaged post-tensioned or pre-tensioned concrete structures by removing steel tendons and forming new concrete post-tensioned beams in their place. The method includes the steps of removing concrete above the tendon to be replaced while leaving concrete under the tendon, releasing any remaining tension in the tendon and removing same, preparing the concrete surface for a pour of new concrete, installing rebars perpendicular to the tendon, installing new tendon and anchorages, pouring concrete and post-tensioning the new tendon in the new beam formed.

11 Claims, 3 Drawing Sheets

METHOD OF REPLACING POST TENSIONED BEAMS

This is a continuation of copending application Ser. No. 07/355,923 filed on May 23, 1989, now abandoned.

BACKGROUND OF THE INVENTION

1. Field of the Invention

This invention relates to a method for repairing post and pre-tensioned concrete structures such as parking ramps whose beams are damaged. More particularly, the method involves the creation of a new post-tensioned beam in a trench where the old tendon and encasing concrete were present.

2. Description of the Related Art

Post-tensioned concrete structures depend on the spaced beams of concrete in which a post-tensioned tendon is positioned. Pre-tensioned structures apply tension to the tendon prior to the concrete pour. With time, salt and other detrimental chemicals tend to break down the concrete and contacts the tendons. Damage to the tendons may severely weaken the integrity of the post-tensioned structure requiring repair. In some cases damage is so severe that the entire deck must be replaced which is extremely expensive and effectively puts the structure out of use until repairs are completed.

An alternative method of repairing such post-tensioned structures is described in Reigstad et al, U.S. Pat. No. 4,574,545, the disclosure of which is incorporated herein by reference. In Reigstad, concrete is repaired either by pulling the individual strands of the steel tendon out and replacing the tendon after reaming the bore, or by releasing tension in the tendon and exposing the tendon from above at its ends and beneath through its central span. After the tendon is removed, new concrete is applied to cover the new tendon. Plywood must be applied to the underside of the slab and be supported overhead by shoring from the slab below as a form for the new concrete placed on the ceiling of the slab.

The Reigstad process involves the use of jackhammers and overhead jackhammer stands from below which remove concrete from the ceiling. The method necessitates the closing of both the floor being worked on and the lower floor where jackhammers must be used and forming must be supported by shoring. The Reigstad process leaves much more than half of the original concrete untouched around the tendon being replaced, for fear that excessive removal of concrete e will cause slab deformation. Thus, a large amount of concrete above the tendon, which may have chloride ions present, is left in place. The new tendon in the Reigstad process is coated to prevent corrosion by this and other sources of chloride ions.

The Reigstad process is particularly inappropriate when the slab being repaired functions as a ceiling for office or retail store space, since such spaces would need to be closed down during the repair process. Unfortunately, complete slab replacement or complete removal of the post-tensioned beams also require the shutdown of any underlying businesses.

Reigstad describes repair methods in which the entire beam is removed by cutting completely through the slab. This method was characterized as being unworkable. The Reigstad process had been known and practiced in the United States since at least as early as 1970.

SUMMARY OF THE INVENTION

The present invention provides a method in which the deteriorated beam, complete with tendon and surrounding concrete, is replaced to form a new beam. Enough concrete is left below the original tendon during the process to provide a form for positioning the new tendon and concrete. The concrete with the highest chloride ion concentration is completely removed in the process. The old concrete under the new beams thus formed functions aesthetically and contributes little, if any, structural strength.

The method of the invention involves the formation of a trench down to the original tendon to completely expose the tendon from above, except adjacent the end anchors. The tension in the tendon is maintained until the concrete is substantially removed, which greatly aids the removal of old concrete because of the upward force of the tendon. Also, the tendon under tension acts as a shield to ensure that a jackhammer does not accidentally break through the ceiling of the lower floor. The exposed tendon is then cut to release any further tension which has not been relieved by the removal of overlying concrete and is removed.

The remaining concrete above the ends adjacent the anchors is removed and a profile groove for the new tendon is cut. The bonding surfaces of the entire trench to which the new beam must be attached is then prepared. The trench is then built up if needed to present the desired tendon profile grade.

Tendon profile rebar retainers are then positioned across the trench to connect the opposing concrete surfaces, prevent spalling, facilitate bonding of the new concrete and retain the position of the new tendon therebelow. The rebar retainers consist of coated rebar which are placed in bores drilled into the trench sides. The rebar are then bonded in place with epoxy or the like and are bent to the desired elevation. Generally, the rebar retainers are placed from the midpoint of the new beam toward the anchors. The retainers are usually to be used during the concave drape region of the new tendon.

The new tendon (preferably coated or sheathed) is woven into the tendon profile groove. It is then attached to new end anchors which preferably include the addition of coated bars anchored into the old concrete perpendicular to the new tendon in a manner similar to that used in installing the rebar retainers. Angled hook bars are also preferably used in the anchorage and are placed parallel with the tendon extending from the new anchor.

In order to improve bonding and corrosion resistance the entire bonding surface of the trench is preferably coated with an epoxy compound, after which concrete is poured. After the new concrete has reached the required strength the new beam is post-tensioned to the specified design load. Protective caps are then placed over the tendon ends at the anchors. The end anchor region pocket is then filled with concrete to complete the new post-tensioned beam.

BRIEF DESCRIPTION OF THE DRAWINGS

The detailed description of the invention including its preferred embodiment is hereinafter described with specific reference being made to the drawings in which.

DESCRIPTION OF THE PREFERRED EMBODIMENTS

Figure 1:
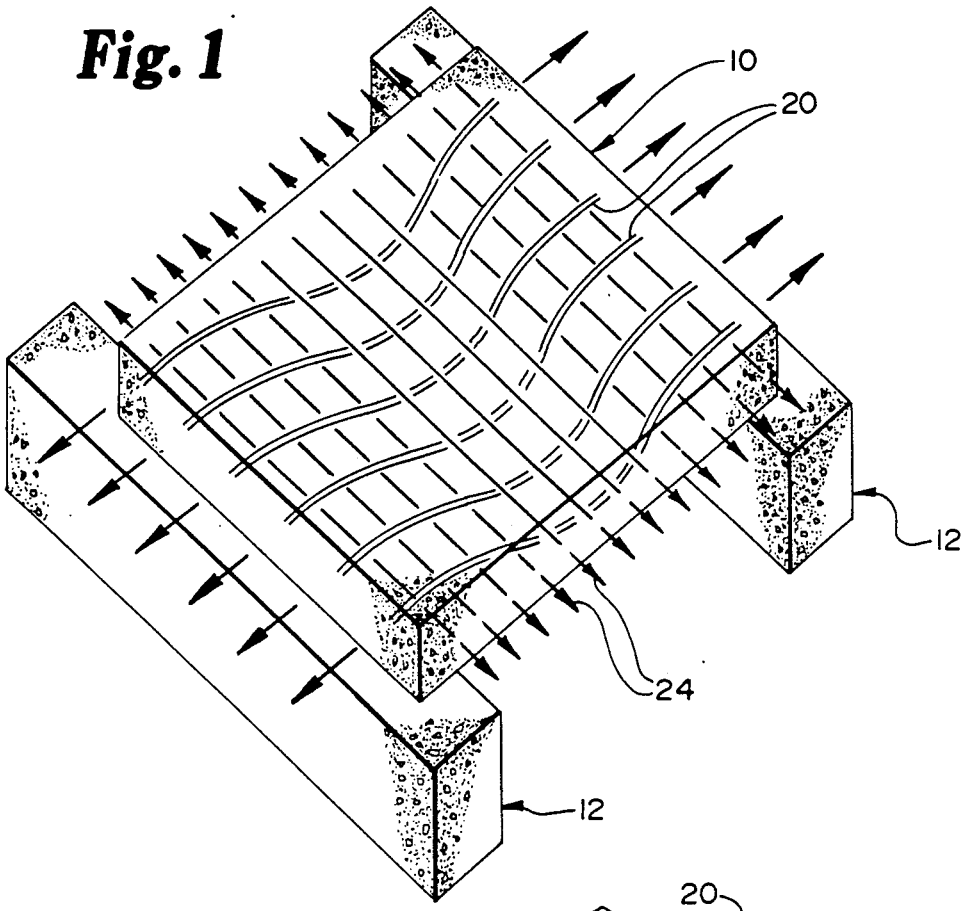
FIG. 1 is a perspective view of a portion of a typical post-tensioned slab showing existing tendons and temperature tendons in phantom.
Figure 2:
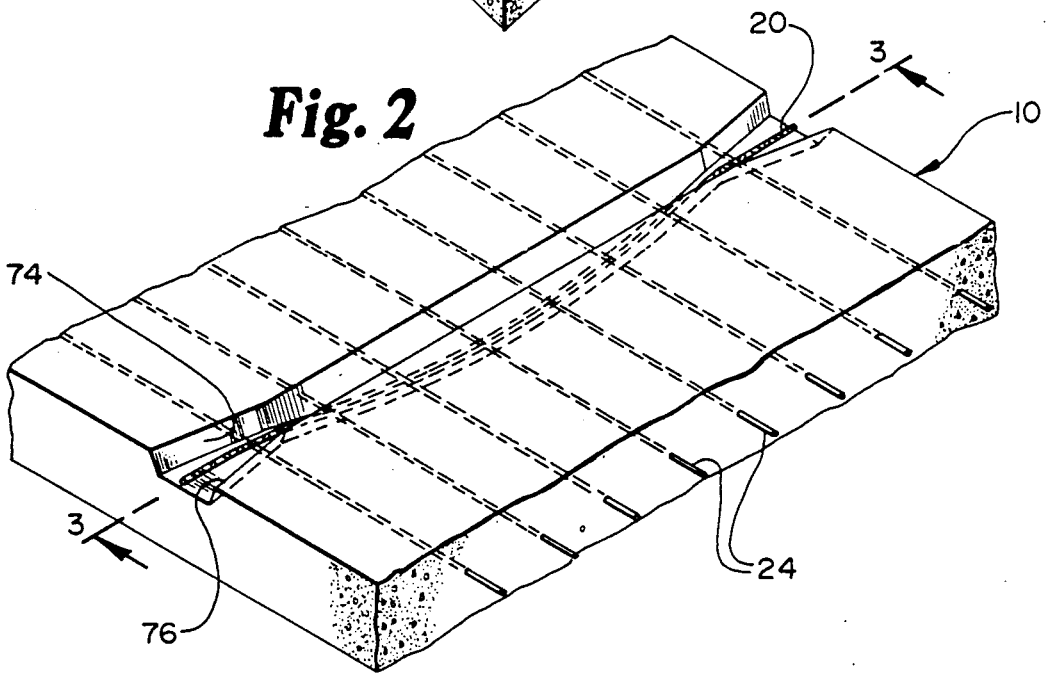
FIG. 2 is a perspective view similar to FIG. 1 in which the old concrete has been removed to form a trench for the new beam.
Figure 3:
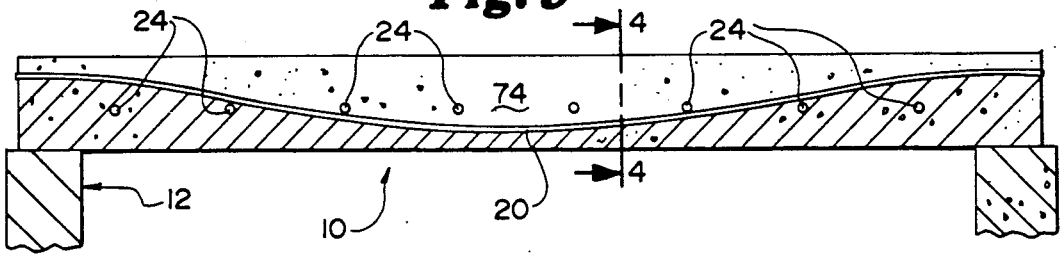
FIG. 3 is a cross-sectional view through lines 3—3 of FIG. 2 showing the trench profile for the new beam.
Figure 4:
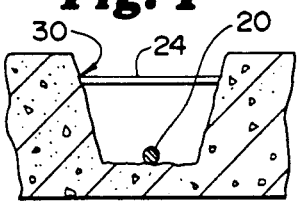
FIG. 4 is a cross-sectional view through lines 4—4 of FIG. 3 showing the cuts made to expose the tendon at its deepest point in the old slab.
Figure 5:
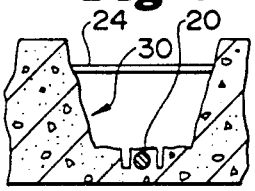
FIG. 5 is a sectional view similar to FIG. 4 showing an alternate method to expose the tendon.

With reference to the drawings in which like reference numerals are used throughout to designate identical or corresponding elements, the process will be seen as involving a slab 10 supported upon beams 12. Slab 10 is a post-tensioned structure having primary tendons 20 extending in one direction and temperature tendons 24 (which may also be post-tensioned) extending perpendicular to the primary tendons 20. Although the description of the invention will refer to repairing post-tensioned structures, it is also applicable to repair of pre-tensioned structures. In these cases, the pre-tensioned tendon is replaced with a post-tensioned tendon in a new beam.

After testing has been conducted to determine which tendons need replacement, the tendons are located by a metal detector. Preferably, the tendons are located with a Rebar Hunter® brand instrument from Matcor, Inc. of Doylestown, PA. Such an instrument locates metal in concrete and displays information on depth. The ends of the tendons 20 to be replaced are exposed by jackhammer to confirm their profile, course and location.

Saw cuts are then formed on both sides of the tendon to establish a trench about six (6) to seven (7) inches in width. The saw depth is set to ensure that any temperature tendons 24 are not cut. Usually, this entails a saw depth of two (2) inches or less. It is preferable to make the saw cuts only about four (4) to six (6) feet in length. Opening this short length of trench allows one to follow the course of the old tendons. Existing tendons may not have been installed in a straight line or at original design depth or elevation.

After the trench has been outlined by the parallel saw cuts, the concrete between the saw cuts is removed until the top of the old tendon is exposed. Removal of concrete may be made by the use of jackhammers. Preferably, a heavier jackhammer is utilized initially to remove the first several inches of concrete, followed by a lighter weight chipping jackhammer. The remaining tension in the tendon assists the removal of concrete by imparting an upward force to the concrete chunks in the trench. Also, the uncut tendon assists in preventing the jackhammers from cutting completely through the old concrete.

The process of concrete removal continues with short lengths of saw cuts and removal of concrete until all but about five (5) feet on both ends of the tendon are exposed. At that time, any remaining tension in the tendon is released by cutting the tendon which is usually cut with a torch. The removal of concrete may release some tension on the tendon.

Tension in the tendon is utilized to assist the concrete removal process. Also, release of tension from stressed tendons by cutting off button heads in end anchors 28 is not preferred, since shim plates may let go.

The tendon thus exposed is then removed from the trench. Preferably, the tendon is cut between temperature tendons and pulled in sections from the trench.

The removal of concrete down to the top of the old tendon preserves the old tendon's profile groove for installation of the new beam. After the remaining concrete at the tendon ends is removed, a vee-shaped profile groove is formed at the bottom of the trench for placement of the new tendon. The vee-shaped groove is formed by saw cutting to the bottom of the old tendon profile groove. It is sawn to the width needed for the number of new tendons to be installed.

Jackhammers with (1-½ inch wide) chisel bits may be used to remove concrete between the saw cuts to define the vee-shaped groove 30. All rubble and debris is then removed from the trench. Enough concrete remains to function as a form for the new concrete pour which will form the new beam. Structurally, this retained concrete contributes little strength to the new beam formed.

Figure 11:
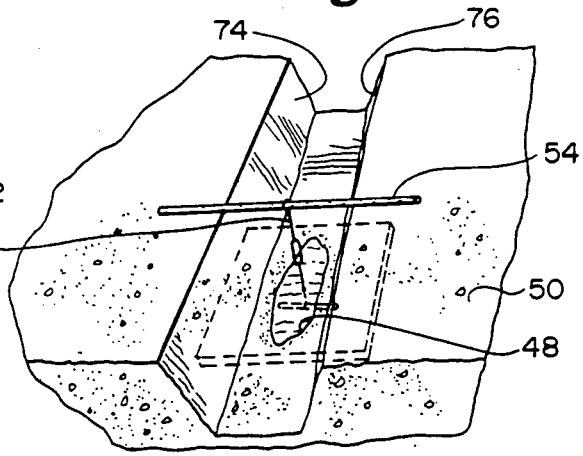
FIG. 11 is an illustration of a means to repair breakthrough regions showing the suspended form in phantom.
Figure 12:
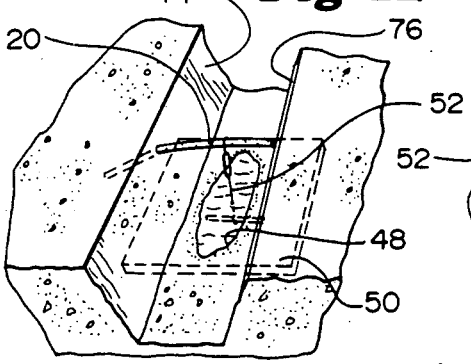
FIG. 12 is an illustration of an alternative means to repair breakthrough regions.

Any breakthrough regions 48 caused by the concrete removal step are repaired. Breakthroughs may occur due to poor placement of the original tendon which was too close to the bottom of the concrete slab. With reference to FIGS. 11 and 12, a repair method is shown in which a plywood form 50 is held beneath the hole 48 by cable 52 which may be attached to a piece of rebar 54. After the concrete is cured, the cable may be cut to remove the rebar 54. Alternatively as shown in FIG. 12, the rebar 54 may be embedded beneath the surface of the beam by securing one or both ends to walls of the old concrete trench.

The entire trench is then prepared for formation of the new beam. All bonding surfaces of the trench are cleared of loose concrete, aggregate or other deleterious materials. Sand or water blasting are suitable cleaning methods. The trench is then vacuumed or blown out.

The tendon profile groove for the new beam is then built up, if needed, in areas where the old tendon was originally too deep or the trench was over-excavated.

As shown in the drawings, the tendon's profile drape creates a concave area in relation to the horizontal plane of the slab surface over a significant length of the tendon. In those areas, the tendons must be retained below the horizontal midpoint of the slab to ensure that the post-tension of the tendon provides the required structural lift and support the beam is to provide. To accomplish this, prevent spalling of concrete, and facilitate the bonding of the new beam to the existing slab a plurality of tendon profile rebar retainers 60 are utilized.

Figure 7:
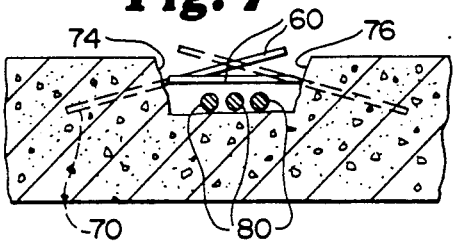
FIG. 7 is a sectional view taken along line 7—7 in FIG. 6 showing the tendon profile rebar retainers relative to the new untensioned tendons.
Figure 6:
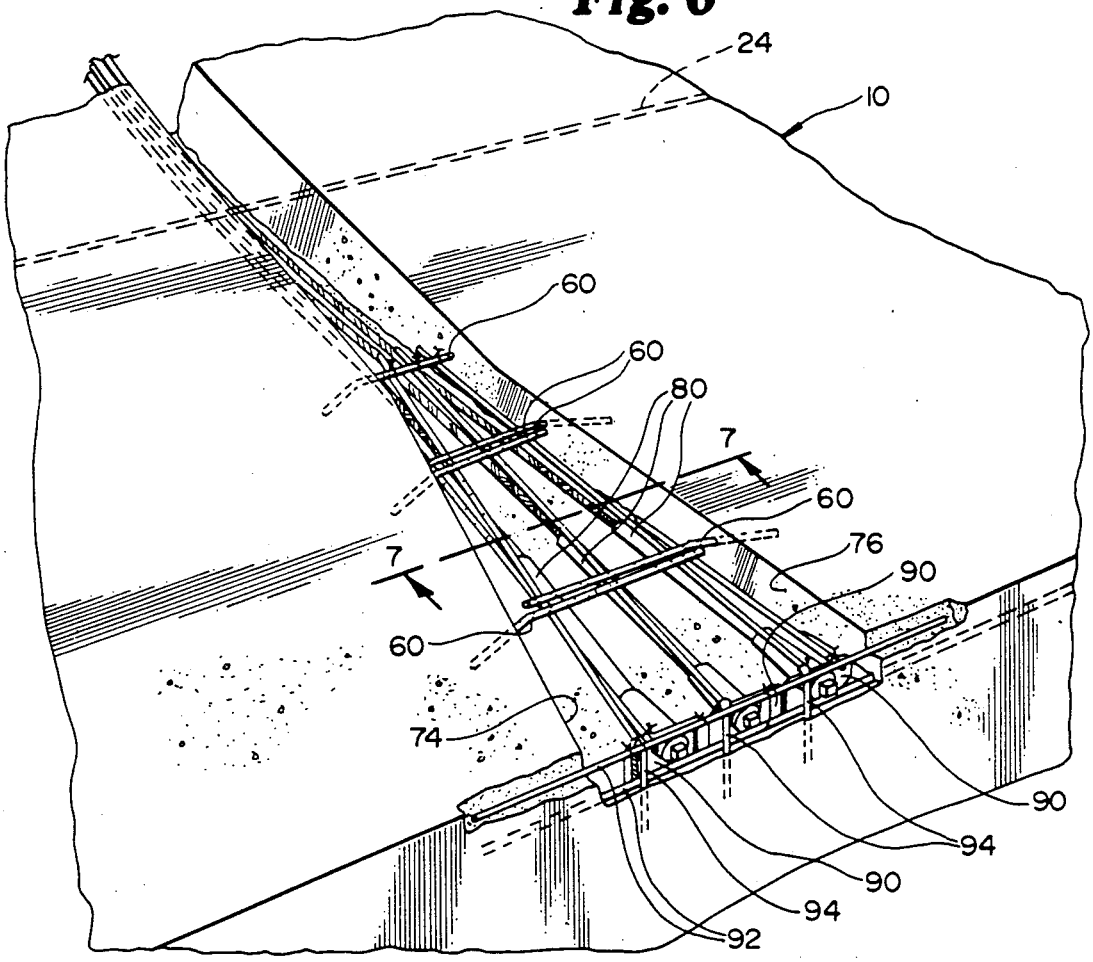
FIG. 6 is a perspective view of the slab and cut trench to show the position of the anchors and new tendons.
Figure 8:
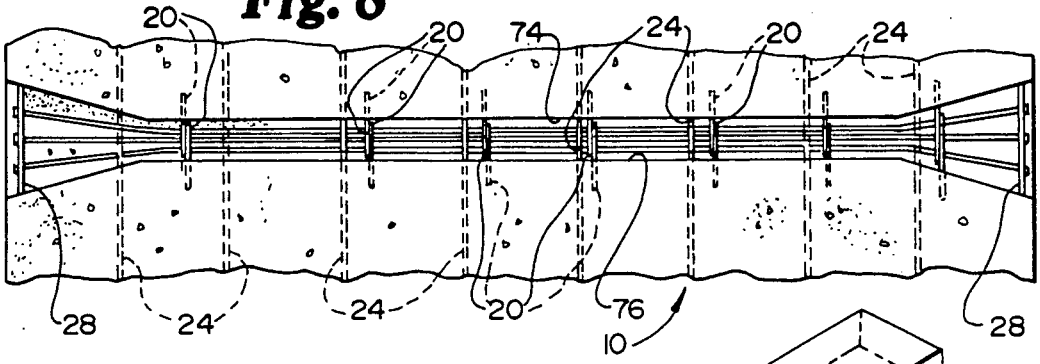
FIG. 8 is a top view of the trench showing the rebar, new tendons and anchor plates.

Rebar retainers 60, as best shown in FIGS. 6 and 7, are placed into angled drill holes 70 in walls 74, 76 of the trench. The rebar retainers 60 are preferably epoxy coated rebar. The drill holes 70 should be close to the bottom of the trench and must be cleared of debris. The rebar retainers 70 are then epoxied in position. The rebar retainers are needed from the midpoint between beams 12 and may be placed at one (1) to two (2) foot centers. The portions of the tendon's concave profile drape which will require retention below the horizontal midpoint of the slab may be about fifteen (15) feet. The length of the concave profile drape and number of rebar retainers 60 required may vary depending on the application.

New tendons 80 are woven into the profile groove positioned under the rebar retainers 60 and temperature tendons 24. Preferably, the tendons are coated or sheathed, such as with polyurethane, for corrosion resistance. Suitable tendons include ½ inch, low relaxation 7-wire stress-relieved strand in accordance with ASTM A416. Such tendons have a breaking load of about 42,000 pounds. New end anchors 90 are constructed as best shown in FIG. 6. In addition to the standard anchor plates 90, it is preferable to include reinforcing bars 92 to strengthen the anchorage. Standard anchor plates are available from many sources, including VSL Corp. of Los Gatos, California. A suitable anchor plate 90 is described in U.S. Pat. No. 4,616,458, the disclosure of which is incorporated herein by reference.

The anchor plate 90 is preferably attached to a plurality of bars 92 perpendicular to the tendon. The bars 92 are anchored to the walls 74, 76 of the trench in much the same manner as the rebar retainer. The bars 92 are epoxied into holes in walls 74, 76 of the trench. Hook bars 94 are positioned over the anchor plate 90 so as to run parallel with the tendons as shown. Hook bars 94 may be on the order of about three (3) feet in length. Both bar 92 and hook bars 94 are preferably coated with epoxy or other corrosion resistant material. The ends of the hook bars are preferably inserted into drill holes in the concrete beam and epoxied in place.

The entire surface of the trench is then preferably coated with an epoxy compound to improve the adherence of the new beam to the original slab. A suitable epoxy is the high modulus, high strength epoxy bonding/grouting adhesive Sikadur® 32 from Sika Corp. of Lyndhurst, New Jersey. The epoxy may also be used to set the rebar retainers.

Figure 9:
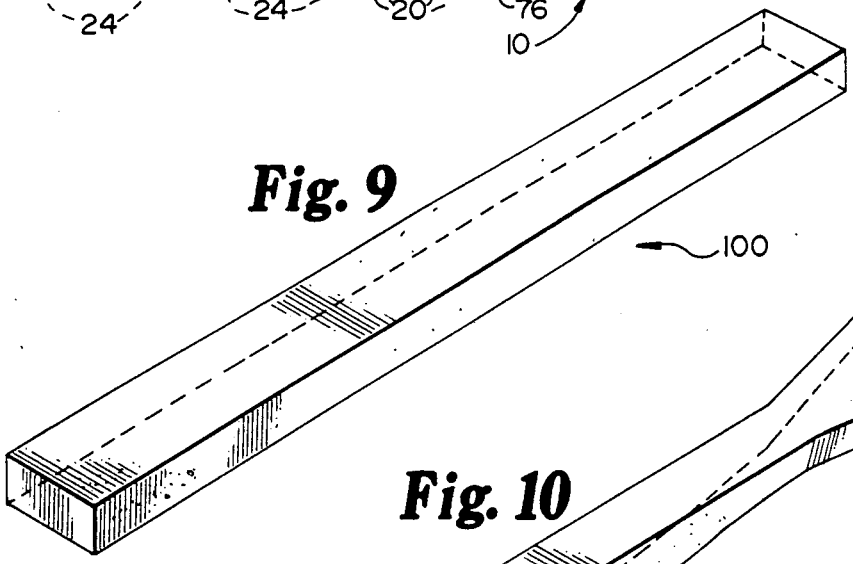
FIG. 9 is an illustration of one form in which the new beam may be made.
Figure 10:
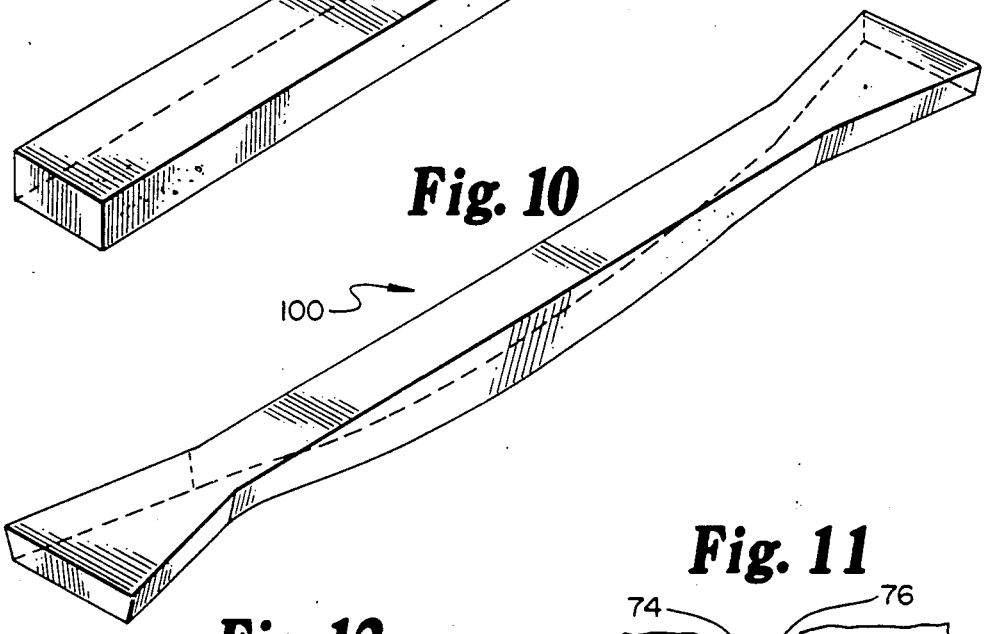
FIG. 10 is an alternative design to the new beam shown in FIG. 9.

Concrete is then poured into the trench to complete the new beam 100. The new beam 100 is shown in FIGS. 9 and 10. It may range from a single rectangular box to the version of FIG. 10. Preferably, the upper surface is coated with a concrete curing compound. The concrete may include a plasticizing, water-reducing and extended slump-life concrete admixture such as Sikament®320 from Sika Corp. of Lyndhurst, New Jersey. Such admixtures are usually added at the ratio of 6-18 fluid ounces per sack of concrete. The concrete may be a Type III Portland mix such as Minnesota Department of Transportation specification 3U18, available from Twin City Concrete, Minnesota.

After the concrete has reached a strength of at least above 5,000 pounds per square inch, the tendons are post-tensioned to the specified design load, which is typically in the range of 27–35 kips. Any cable grease on the cable should not be removed since it makes for easier installation of a cap and since it adds corrosion protection. A protective cap may be placed on the protruding tendon beyond the anchor plate. The stressing pocket area is then filled with a non-shrink concrete to complete the beam replacement.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method for repairing a defective post or pretensioned concrete slab comprising the steps of:

(a) removing all original above said original defective tendon expose at least the upper surface of said original tendon while leaving an underlying portion of the original concrete along the length of the defective tendon;

(b) relieving any remaining tension in said exposed tendon and removing said tendon from the trench so formed;

(c) installing at least one tendon profile rebar retainer into said original solid concrete in the sidewall of said trench so as to extend at least partially across said trench adjacent the middle region of the length of the trench;

(d) constructing end anchorages where needed to replace defective original anchorages for the new tendon or tendons;

(e) weaving a new tendon or tendons into said trench, said tendon or tendons being supported by said at least one tendon profile rebar retainer, operatively positioning the ends of said tendon or tendons to said end anchorages (f) coating the bonding surface of said trench with a curable epoxy bonding compound;

(g) filling the trench with new concrete to completely encase said new tendon in concrete, thereby forming a new concrete beam; and (h) post-tensioning said tendon or tendons.

2. A method for replacing beams consisting of post or pre-tensioned tendons in concrete, said method comprising the steps of:

(a) removing all original concrete directly above an original tendon to be replaced along substantially the length of said tendon between its original end anchorages, thereby forming a trench;

(b) releasing any remaining tension in said original tendon, exposing the remainder of the tendon at each end anchorage and removing said tendon;

(c) constructing new end anchorages where needed to replace defective anchorages for a new tendon or tendons in a new beam to be formed in said trench;

(d) installing at least one new tendon in said trench between said end anchorages;

(e) placing concrete into said trench to encase said new tendon or tendons, in concrete, thereby forming a replacement beam; and (f) post-tensioning said tendon or tendons.

3. The method of claim 2 further including the steps of installing rebar retainers into said original solid concrete so as to extend at least partially across said trench prior to placing new concrete into said trench.

4. The method of claim 2 further including the step of coating the bonding surface of said trench with a curable epoxy bonding compound prior to placing new concrete in said trench.

5. The method of claim 2 wherein said trench is built up with concrete to the desired grade and elevation for said new tendon or tendons along their length prior to installation of said new tendon or tendons in said trench.

6. The method of claim 2 wherein step (a) includes the step of cutting a trench on either side of said original tendon.

7. The method of claim 2 further including the step of installing at least one tendon profile rebar retainer into said original solid concrete so as to extend at least partially across said trench adjacent the middle of the length of the trench.

8. The method of claim 2 wherein step (c) includes the installation of rebars parallel to each end anchor plate adjacent said anchor plates, said rebars being secured into bores formed in walls of said trench; said step further including the installation of bars secured to said anchor plates, said bars being generally parallel to the new tendon and within said trench.

9. The method of claim 8 wherein said bars are secured into holes bored in the original concrete at the end of said bars adjacent said anchor plates.

10. The method of claim 2 wherein the removal of concrete in step (a) involves the formation of saw cuts on either side of the original tendon, removal of concrete between the cuts with hammers until the top of the tendon is exposed, forming saw cuts on each side of said tendon to the bottom of said tendon and breaking said tendon free from the remaining concrete.

11. The method of claim 2 wherein repairs of openings accidentally cut completely through said slab in step (a) are repaired by suspended flat form members below said openings from wire attached to rebar secured to the sides of the trench such that said form members close off each said opening.

* * * * *